US006695723B2

(12) United States Patent
Leal et al.

(10) Patent No.: US 6,695,723 B2
(45) Date of Patent: Feb. 24, 2004

(54) APPARATUS FOR, AND METHOD OF, POSITIONING MOVABLE ELEMENTS ON A T-BALL MECHANISM FOR PROPULSION

(75) Inventors: Jose E. Leal, Stow, MA (US); John F. Barletta, Southborough, MA (US)

(73) Assignee: Sport Fun, Inc., Los Angeles, CA (US)

( * ) Notice: Subject to any disclaimer, the term of this patent is extended or adjusted under 35 U.S.C. 154(b) by 0 days.

(21) Appl. No.: 10/097,047

(22) Filed: Mar. 12, 2002

(65) Prior Publication Data

US 2003/0176244 A1 Sep. 18, 2003

(51) Int. Cl.[7] ..... A63B 71/00
(52) U.S. Cl. ..... 473/417; 124/79
(58) Field of Search ..... 473/417, 419, 473/422, 508, 420, 423, 454, 136, 137; 124/5, 78, 79; 434/237

(56) References Cited

U.S. PATENT DOCUMENTS 3,778,067 A * 12/1973 Gentiluomo ..... 473/133
5,078,401 A * 1/1992 Fehrenbach et al. ..... 473/133
5,672,124 A * 9/1997 Pecoraro et al. ..... 473/417
6,190,271 B1 * 2/2001 Rappaport et al. ..... 473/451

* cited by examiner

*Primary Examiner*—Paul T. Sewell
*Assistant Examiner*—M. Chambers
(74) *Attorney, Agent, or Firm*—Fulwider Patton, et al.; Ellsworth R. Roston

(57) ABSTRACT

A propulsion member (e.g. a bat) has an external switch and an internally disposed transistor which transmits signals when the switch is manually closed. A receiver in a tee mechanism receives the signals and causes a tee in the mechanism to move upwardly from a rest position to an operative position. As the tee moves upwardly to the operative position, an element (e.g. a wiffle ball) moves on a ramp to a supportive position at the top of the tee. When the tee is in the operative position, a player holding the propulsion member swings the member against the ball. This is helpful to young children (e.g. eight (8) years old or younger) in learning how to hit a baseball.

2 Claims, 4 Drawing Sheets

FIG. 4
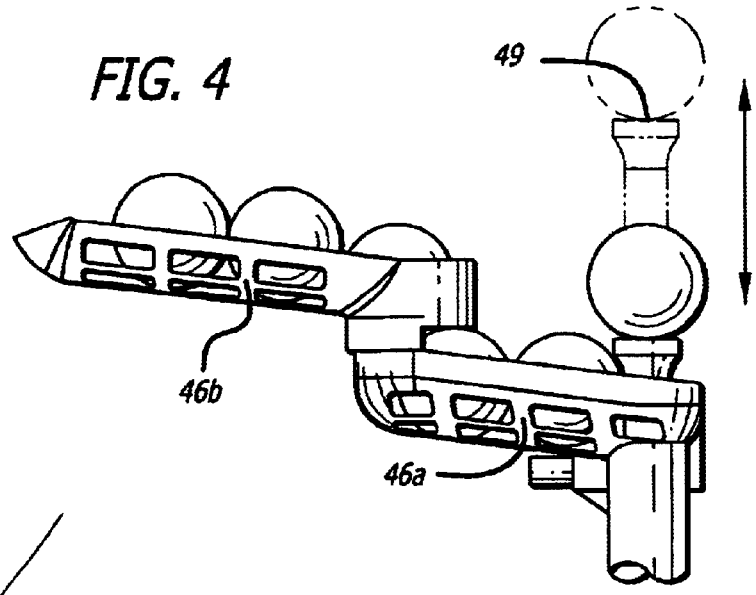
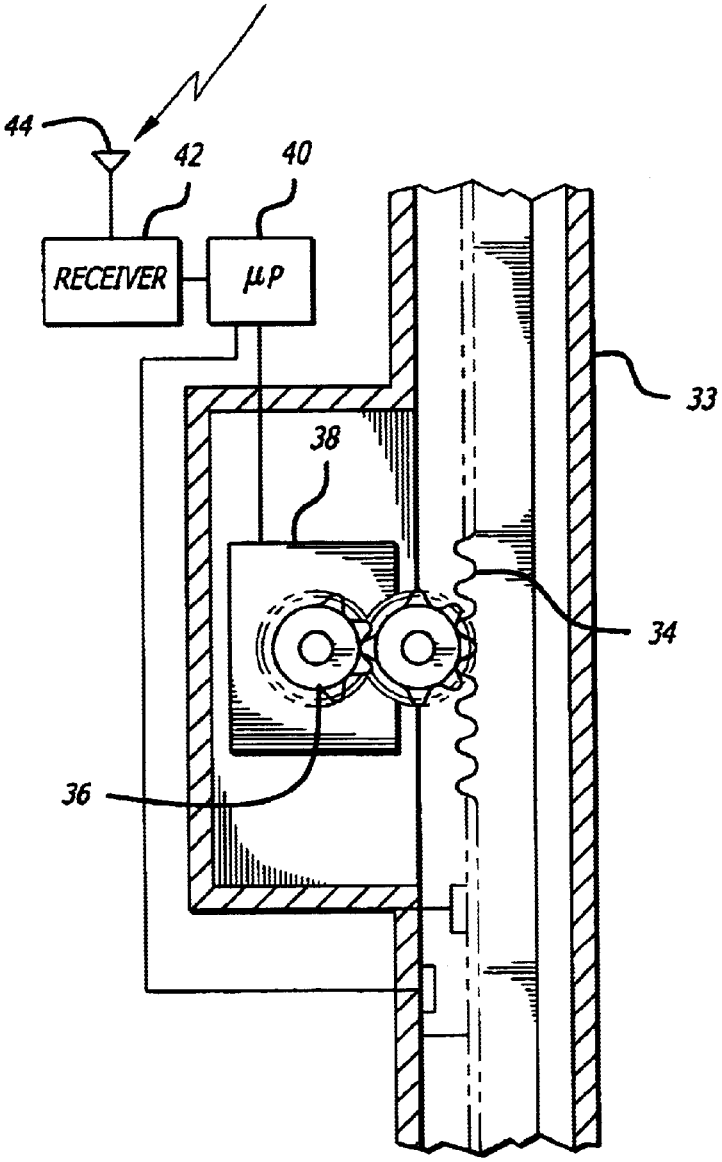
FIG. 5

APPARATUS FOR, AND METHOD OF, POSITIONING MOVABLE ELEMENTS ON A T-BALL MECHANISM FOR PROPULSION

This invention relates to systems for, and methods of, providing a tee mechanism including a tee on which a ball can be disposed so that a child can practice hitting the ball with a bat. More particularly, the invention relates to a system for, and method of, controlling a disposition of a ball on a tee in accordance with the transmission of signals from the bat under the control of the child holding the bat.

BACKGROUND OF THE PREFERRED EMBODIMENTS OF THE INVENTION

Baseball has been designated for years in the United States as the national pastime. Actually, baseball constitutes the national pastime in a number of countries in the world including Japan and the countries in Central America. The fundamentals of baseball are in two (2) categories-hitting and catching. Hitting is perhaps more difficult than catching. Pitching machines have been in existence for decades to provide an opportunity for baseball players to practice hitting. When activated, the machines propel balls to a batter who stands in a batting cage. The balls are propelled on a sequential basis to the batter at a relatively high speed.

U.S. Pat. No. 6,190,271 issued on Feb. 20, 2001 to Mark J. Rappaport and Jose E. Leal as joint inventors and licensed to the same licensee as the licensee of this patent application discloses and claims a system for, and method of, propelling balls to a batter, who is primarily a youngster between the ages of about 9 to 12. The system and method disclosed in U.S. Pat. No. 6,190,271 provide a bat with a switch on the bat and a transmitter in the bat. When the batter presses the switch to close the switch, the transmitter sends signals to a propulsion mechanism. The propulsion mechanism then propels a ball toward the batter. The ball is preferably a wiffle type of ball so that it will not travel a long distance when hit and so that a bystander will not be injured if struck by the ball.

Special formats have been specially developed for young children (e.g. children below the age of about nine (9) years old) to help them practice hitting a baseball. In these special formats, a softball is disposed on the top of a tee which extends upwardly from a support surface. A child then swings a bat against the ball to hit the ball. Leagues have been formed with a plurality of teams each having a particular number of players eight (8) years old or younger.

BRIEF DESCRIPTION OF A PREFERRED EMBODIMENT OF THE INVENTION

In a preferred embodiment of the invention, a propulsion member (e.g. a bat) has an external switch and an internally disposed transmitter which transmits signals when the switch is manually closed. A receiver in a tee mechanism receives the signals and causes a tee in the mechanism to move upwardly from a rest position to an operative position. As the tee moves upwardly to the operative position, an element (e.g. a wiffle ball) moves on a ramp to a supportive position at the top of the tee. When the tee is in the operative position, a player holding the propulsion member swings the member against the ball. This is helpful to young children (e.g. eight (8) years old or younger) in learning how to hit a baseball.

BRIEF DESCRIPTION OF THE DRAWINGS

In the drawings:

FIG. 4 is an enlarged fragmentary perspective view of a tee disposed in the tee mechanism and movable upwardly and downwardly and of a ramp for holding the movable elements (e.g. wiffle balls) and for transferring a successive one of the movable elements to the tee every time that the tee is raised;

FIG. 5 is an enlarged fragmentary sectional view in elevation of a mechanism for moving the tee upwardly to transfer a successive one of the movable elements (e.g. wiffle balls) on the ramp to the tee during an upward movement of the tee;

DETAILED DESCRIPTION OF A PREFERRED EMBODIMENTS OF THE INVENTION

Figure 1:
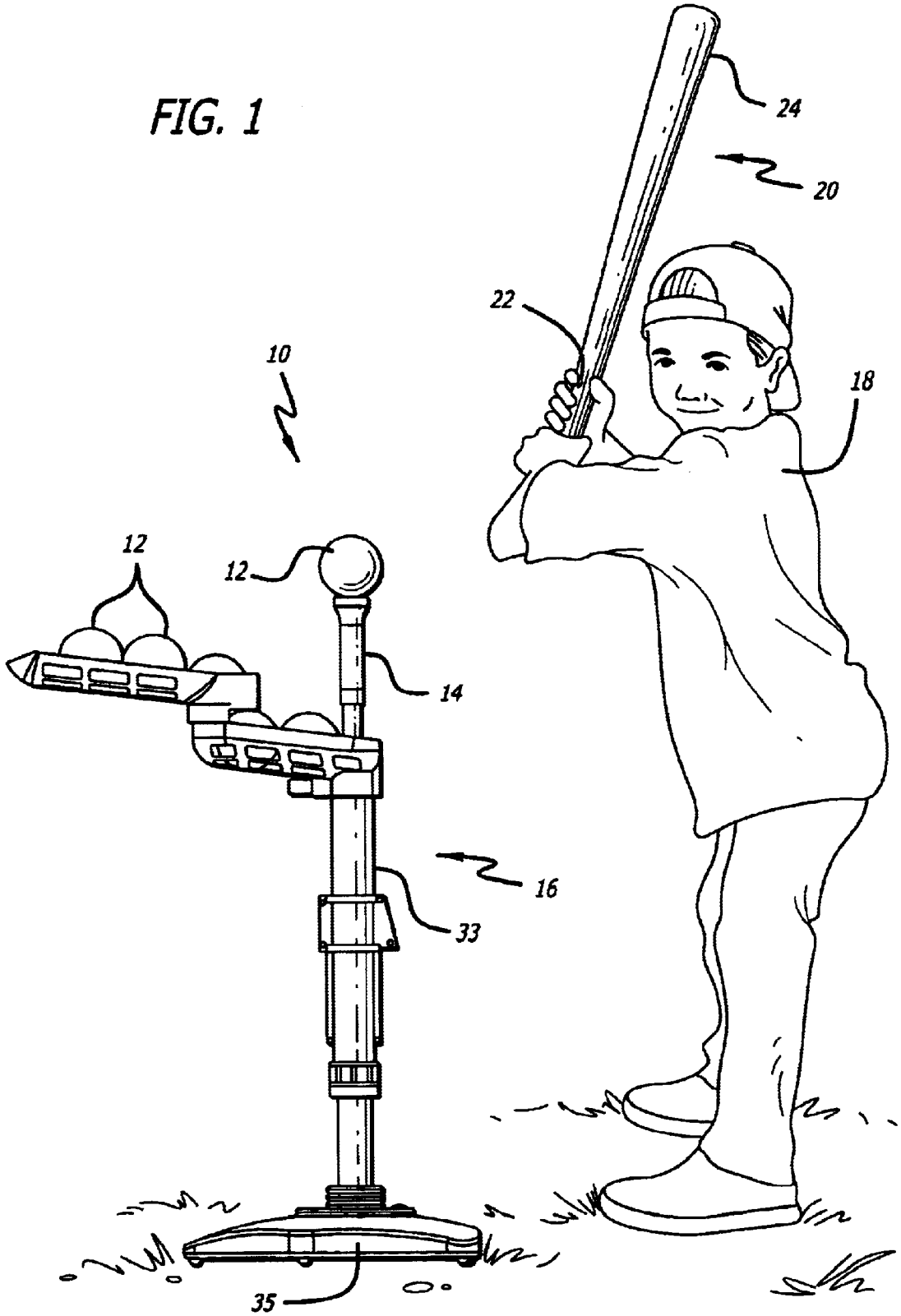
FIG. 1 is a schematic perspective view of a player holding a propulsion member (e.g. a bat in a position to strike a movable element (e.g. a wiffle ball) disposed on a tee mechanism constituting a preferred embodiment of the invention.
Figure 2:
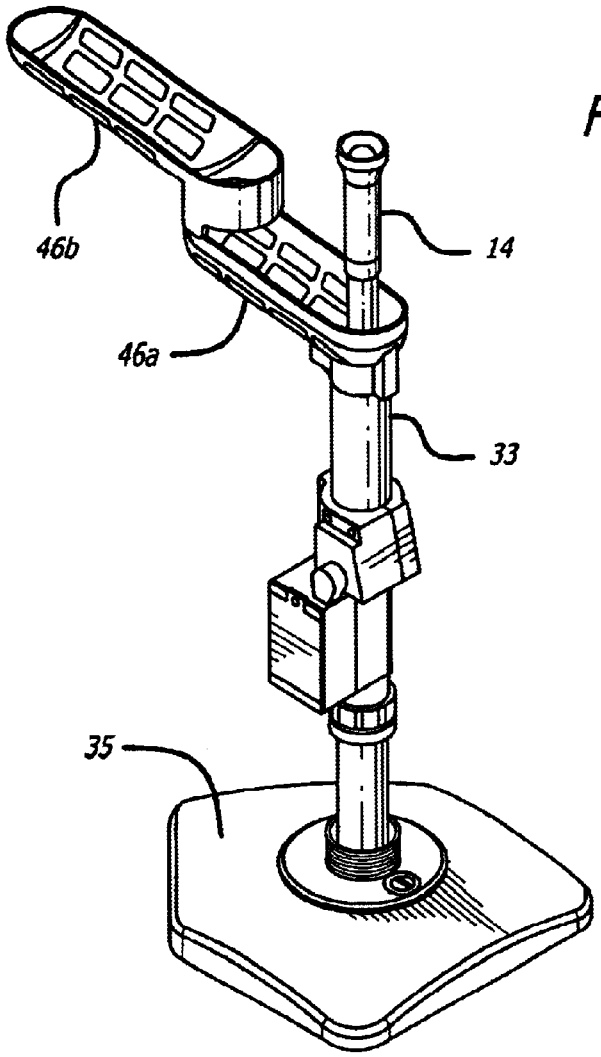
FIG. 2 is a schematic perspective view of the tee mechanism shown in FIG. 1 as seen from a different position than the position of the tee mechanism in FIG. 1.
Figure 3:
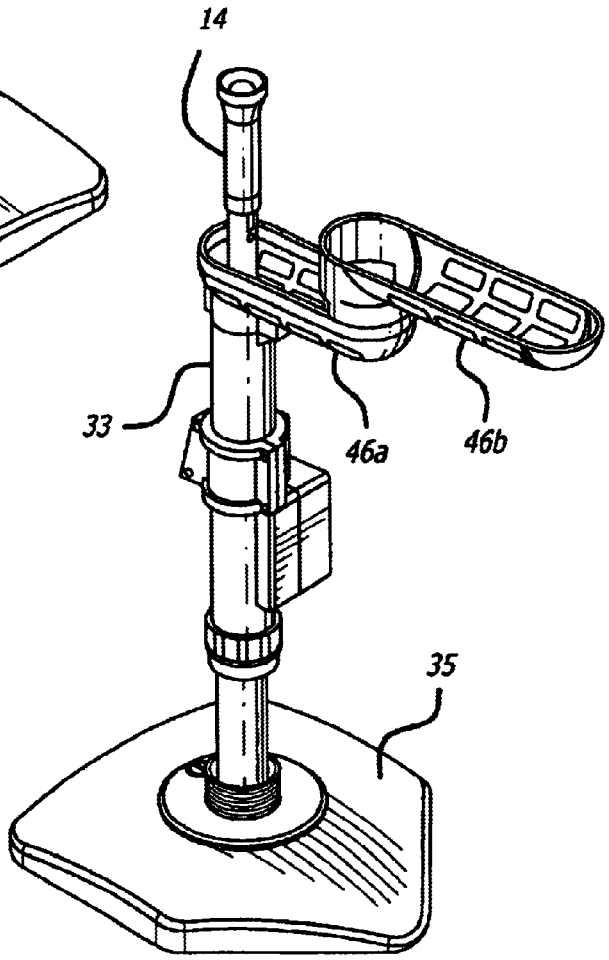
FIG. 3 is a schematic perspective view of the tee mechanism as seen from a different position than the positions shown in FIGS. 1 and 2.
Figure 6:
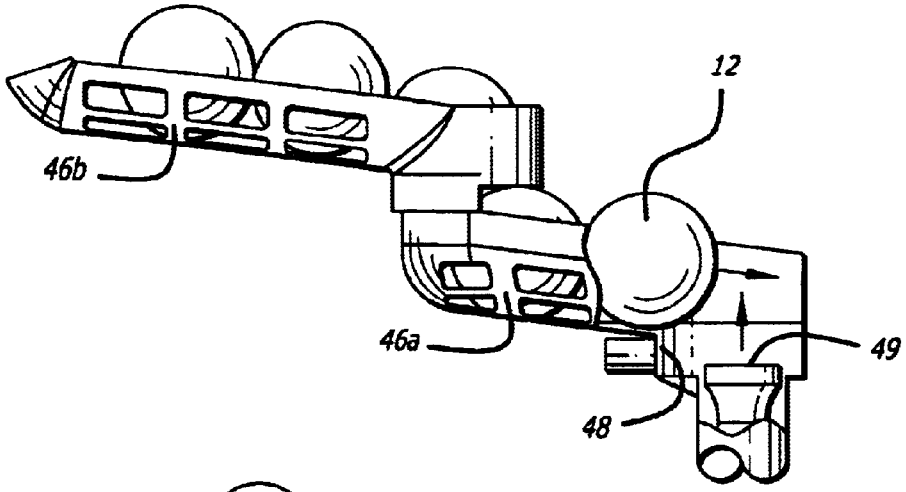
FIG. 6 is an enlarged fragmentary perspective view of the ramp and the tee at the instant that the successive one of the movable elements (e.g. wiffle balls) on the ramp is transferred to the tee.
Figure 7:
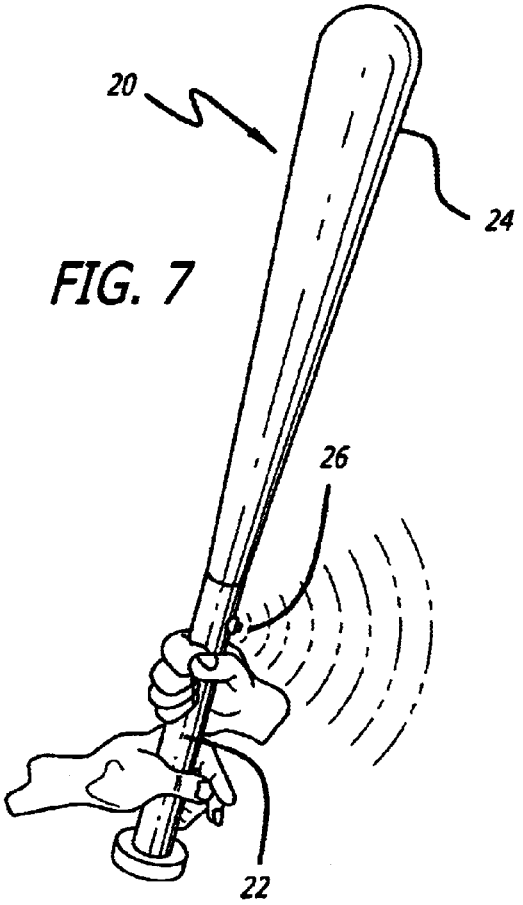
FIG. 7 is a perspective view of the propulsion mechanism (e.g. the bat) and the switch disposed on the exterior surface of the propulsion member to institute a disposition of the movable element (e.g. the wiffle ball) on the tee when the switch is manually closed.

FIGS. 1–9 show a preferred embodiment of apparatus generally indicated at 10 for providing movable elements (e.g. wiffle balls) 12 on a tee 14 in a tee mechanism generally indicated at 16. When one of the wiffle balls 14 is disposed on the tee 14, a hitter (e.g. a batter) 18 (FIGS. 1 and 7) can impact the wiffle ball 12 with a propulsion member (e.g. a bat) 20 to practice hitting the wiffle ball. The apparatus 10 is intended to be used primarily by young children generally eight (8) years old or younger to practice their hitting techniques.

The bat 20 may be conventional. It has a narrow portion 22 for gripping by the hitter and it has an expanded portion 24 for impact with the ball 12. A manually operated switch 26 is disposed on the bat 20, preferably between the gripping portion 22 and the hitting portion 24. A transmitter 28 (FIG. 8) is disposed in the bat 20, preferably at a position displaced from the hitting portion 24. The switch 20 and the transmitter 28 are connected with a battery 30 in an electrical circuit generally indicated at 32 in FIG. 8.

The tee mechanism 16 includes a housing 33 within which the tee 14 is disposed. The tee 14 in the tee mechanism 16 constitutes an elongated rod which preferably extends in a substantially vertical direction. The tee mechanism 16 includes a base 35 on which the tee 14 is supported. A rack gear 34 (FIG. 5) disposed within the housing 33 is formed on one side of the tee at an intermediate position along the length of the tee. The rack gear 34 meshes with a pinion gear 36 which is driven by a motor 38, preferably a direct current motor. The operation of the motor 33 is controlled by a microprocessor 40. Signals are introduced to the microprocessor 40 from a receiver 42, the input of which is connected to an antenna 44. The antenna 44 receives the signals from the transmitter 28.

Ramp members 46*a* and 46*b* are provided to hold a plurality of the wiffle balls 12 in a stacked relationship. A movable detent 48 is provided at a leading position in the ramp 46*a* (FIG. 6) to prevent any of the wiffle balls 12 in the ramps 46*a* and 46*b* from leaving the ramps until the detent is moved downwardly in FIG. 4 by a signal from the microprocessor 40. When this occurs, the leading one of the balls 12 in the ramp 46*a* is released from the ramp to become deposited on a cupped portion 49 at the top of the tee.

Figure 9:
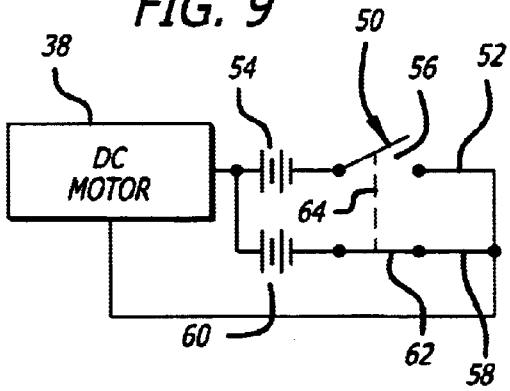
FIG. 9 is a schematic circuit diagram which includes a motor for providing controlled movements of the tee upwardly and downwardly in the tee mechanism in accordance with the transmission of signals from the bat.
Figure 8:
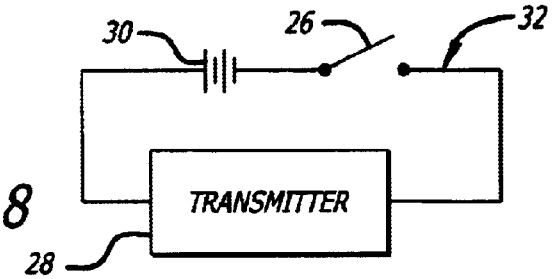
FIG. 8 is a schematic circuit diagram which includes the switch on the propulsion member (e.g. the bat) and the transmitter in the propulsion member.

The circuitry for operating the motor 38 is generally indicated at 50 in FIG. 9. The circuitry 48 includes a first series circuit 52 including a first battery 54, a switch 56 and the motor 38 in FIG. 9. The circuitry 50 also includes a second series circuit 58 including the motor 38, a battery 60 and a switch 62. The switches 56 and 62 are respectively disposed at the bottom and top of the path of movement of the tee 14 in the downward and upward directions. The switches 56 and 62 are mechanically or electrically ganged so that one of the switches is open at any instant and the other one of the switches is closed at that instant. The ganging of the switches 50 and 54 is shown in FIG. 9 by broken lines 64.

When the batter 18 desires to hit one of the wiffle balls 12, the batter presses the switch 26. This causes the circuit 32 in FIG. 8 to become activated and the transmitter 28 to send signals to the receiver 42 (FIG. 5) in the tee mechanism 16. The microprocessor 40 responds to these signals by activating the motor 38, thereby producing a movement of the tee 14 in the tee mechanism 16. When the motor 38 is activated, the tee 14 may preferably be at the upper position of the upward and downward movement of the tee. At this position, the switch 56 at the top position of the tee 14 movement is closed and the ganged switch 62 at the bottom end of the upward movement of the tee is open. This causes the tee 14 to move downwardly to the bottom position of the tee.

The switch 62 then closes and the switch 56 opens. This causes the tee 14 to move upwardly. When the tee 14 reaches a position corresponding to that indicated in FIG. 6, the microprocessor 40 causes the movable detent 48 to become recessed, thus freeing the movable element (e.g. ball 12) at the leading position in the ramp 46*a* to become positioned on the cupped portion 49 at the top of the tee 14. The tee 14 then continues its upward movement to the position shown in broken lines in FIG. 4. The batter 18 then positions himself, as shown in FIG. 1, to hit the wiffle ball 12.

The batter 18 may subsequently wish to hit another ball. The batter then closes the switch 26 to provide for the transmission of signals to the tee mechanism 16. The tee 14 then moves downwardly to the bottom position and thereafter upwardly to receive the next one of the wiffle balls 12 in the ramp 46*a*. In this way, the batter 18 is able to practice his hitting with wiffle balls 12 which, even when hit well, do not travel far so that they can be easily retrieved and used again. Furthermore, the wiffle balls 12 do not injure any bystander.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the claims.

What is claimed is:

1. In combination for providing for the propulsion of a movable member, a base, a housing extending upwardly from the base, a tee disposed in the housing and having a rest position and an operative position above the rest position and movable between the rest and operative positions, the tee being constructed at its upper end to receive and hold the movable element during the upward movement of the tee from the rest position to the operative position, a ramp positioned relative to the tee and constructed to hold the movable element and to transfer the movable element to the upper end of the tee during the upward movement of the tee from the rest position to the operative position, a motor for moving the tee upwardly from the rest position to the operative position, a detent disposal relative to the tee for providing for the transfer of the movable element on the ramp to the tee during the upward movement of the tee, electrical circuitry for synchronizing the operation of the motor and the detent to provide for the transfer of the movable element from the ramp to the tee during the upward movement of the tee, a motor coupled to the tee for moving the tee between the rest position and the inoperative position, a pinion gear disposed in a co-operative relationship with the motor for rotation in accordance with the rotation of the motor, a rack gear coupled to the tee and the pinion gear for moving the tee upwardly from the rest position to the operative position in accordance with the operation of the motor, a propulsion member for propelling the movable element, a switch disposed on the propulsion member and having operative and inoperative relationships, and a transmitter disposed in the propulsion member in a circuit with the switch for transmitting signals to the tee in the operative relationship of the switch to provide for an energizing of the motor.

2. In a combination as set forth in claim 1 herein the movable element is a ball and the ball is adapted to be propelled by a bat.

* * * * *